United States Patent [19]

Holmes

[11] Patent Number: 4,736,540

[45] Date of Patent: Apr. 12, 1988

[54] MAGAZINE CAP AND TUBE WRENCH COMBINATION

[76] Inventor: Jerry B. Holmes, Rte. 1, Box 241, Huntingdon, Tenn. 38344

[21] Appl. No.: 67,158

[22] Filed: Jun. 29, 1987

[51] Int. Cl.[4] ..... F41C 27/00

[52] U.S. Cl. ..... 42/90; 42/49.01

[58] Field of Search ..... 42/49.01, 49.02, 79, 42/90, 106

[56] References Cited

U.S. PATENT DOCUMENTS

| | | | |
|---|---|---|---|
| 4,087,930 | 5/1978 | Grehl | 42/49.01 |
| 4,310,982 | 1/1982 | Kast et al. | 42/49.01 |
| 4,386,477 | 6/1983 | Briley | 42/79 |
| 4,602,449 | 7/1986 | Holmes | 42/49.02 |

*Primary Examiner*—Charles T. Jordan
*Attorney, Agent, or Firm*—Pitts and Brittian

[57] ABSTRACT

A combined magazine cap and choke wrench (10) for use with a shotgun (12) having a tubular magazine (16). The magazine cap and choke wrench (10) comprises a cap body (26) defining an annular recess (28) for releasably receiving the outboard end portion (22) of the tubular magazine (16) of a shotgun (12), whereby the barrel (14) and magazine (16) of the shotgun are secured together and/or the fore-end grip (24) of the shotgun is held in place. The combined magazine cap and choke wrench (10) further comprises a choke wrench portion (32) mounted on the cap body (26). The wrench portion (32) includes at least two spline members (52) for registering with and for being releasably received in the wrench slots (42) of a tubular shotgun choke (36) such that when the spline members (52) are seated in the wrench slots (42) selective rotation of the cap body (26) results in facilitating installation and removal of the choke (36) from the barrel (14) of the shotgun (12). In the preferred embodiment, the wrench portion further includes guide means to assist in the proper seating of the spline members (52) in the slots of the choke (36).

16 Claims, 3 Drawing Sheets

MAGAZINE CAP AND TUBE WRENCH COMBINATION

DESCRIPTION

TECHNICAL FIELD

This invention relates to magazine caps for use with shotguns having tubular magazines and also relates to choke wrenches for installing and removing shotgun chokes which are releasably mounted in the barrels of shotguns. In this particular invention, the combined magazine cap and choke wrench includes a cap body for being releasably received on the outboard end of a magazine and a wrench portion for facilitating the installation and removal of a shotgun choke.

BACKGROUND ART

Certain conventional shotguns are provided with a tubular magazine which is disposed beneath the barrel of the shotgun. In some such shotguns, the barrel is provided with a bracket by which the outboard end portion of the magazine is supported, and to releasably secure the magazine in the bracket, a magazine cap is threadably received on the outboard end portion of the magazine so as to engage the bracket. In other shotguns the magazine cap serves to secure the fore-end grip of the shotgun in place. In this regard, the fore-end grip substantially surrounds the magazine and seats against the front of the receiver of the shotgun. The magazine cap is threadably received by the outboard end portion of the magazine and tightened against the grip, forcing the grip against the receiver, thereby holding the grip in place.

Also, certain conventional shotguns include barrels which define threaded muzzle portions which are receptive of chokes or choke tubes. Shotgun chokes serve to control the pattern of the shot discharged from the barrel, and the ability to interchange various chokes enhances the versatility of the shotgun. In order to facilitate the installation and removal of the chokes, most chokes are provided at their forward end portions with at least two slots which are receptive of the splines of a conventional choke wrench. Accordingly, heretofore in order to interchange chokes, the shooter or operator of the shotgun had to carry a choke wrench, and if the wrench was lost during a hunt or left behind, the choke which was installed in the barrel could not be removed.

Therefore, it is an object of the present invention to provide a combined magazine cap and choke wrench which serves to secure the barrel and tubular magazine of a shotgun together and/or to hold the fore-end grip of the shotgun in place.

It is a further object of the present invention to provide a combined magazine cap and choke wrench which comprises a wrench portion for installing and removing a shotgun choke so as to obviate the need to carry a separate choke wrench.

It is also an object of the present invention to provide a combined magazine cap and choke wrench that is inexpensive to manufacture.

DISCLOSURE OF THE INVENTION

Other objects and advantages will be accomplished by the present invention which provides a combined magazine cap and choke wrench for use with a shotgun having a tubular magazine. The magazine cap and choke wrench comprises a cap body defining a threaded annular recess for releasably receiving the outboard end portion of the tubular magazine of a shotgun, whereby the barrel and magazine of the shotgun are secured together and/or the fore-end grip of the shotgun is held in place. The combined magazine cap and choke wrench further comprises a choke wrench portion mounted on the cap body. The wrench portion includes at least two spline members for registering with, and for being releasably received in, the wrench slots of a tubular shotgun choke such that when the spline members are seated in the wrench slots, selective rotation of the cap body results in rotation of the choke thereby facilitating installation and removal of the choke from the barrel of a shotgun. In the preferred embodiment, the wrench portion further comprises guide means to assist in the proper seating of the spline members in the slots of the choke.

BRIEF DESCRIPTION OF THE DRAWINGS

The above-mentioned features of the present invention will become more clearly understood from the following detailed description of the invention read together with the drawings in which.

BEST MODE FOR CARRYING OUT THE INVENTION

A combined magazine cap and choke wrench incorporating various features of the present invention is illustrated generally at 10 in the figures. As will be understood from the discussion which follows, the magazine cap 10 is designed to be threadably received on the outboard end of the tubular magazine of a shotgun for securing the magazine to the barrel of the shotgun and/or for securing the fore-end grip of the shotgun in position. The magazine cap 10 also functions as a wrench for removing a choke from the muzzle of the shotgun such that the operator of the shotgun is not required to carry a separate choke wrench.

Figure 3:
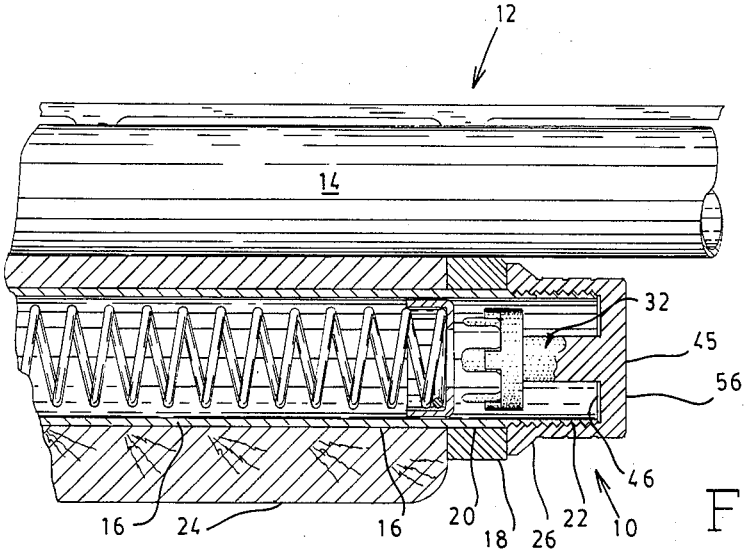
FIG. 3 illustrates a side elevation view, partially in section, of a combined magazine cap and choke wrench of the present invention as it is installed on the tubular magazine of a conventional shotgun.

In FIG. 3 a partial side elevation view of a shotgun 12 provided with a magazine cap 10 of the present invention is illustrated. It will be appreciated by those skilled in the art that the shotgun 12 of FIG. 3 is illustrative of only one specific embodiment of a tubular magazine shotgun and the magazine cap 10 can be utilized with various shotguns having tubular magazines. The shotgun 12 comprises a barrel 14 under which is mounted a tubular magazine 16 for holding shotgun shells (not shown) and for supplying such shotgun shells to the receiver (not shown) of the shotgun 12. In the illustrated shotgun 12, the barrel 14 carries a bracket 18 provided with an opening 20 through which the threaded outboard end portion 22 of the magazine 16 is received. A fore-end grip 24 is provided which substantially surrounds the magazine 16, whereby the forward end of the shotgun 12 can be grasped and supported.

Figure 1:
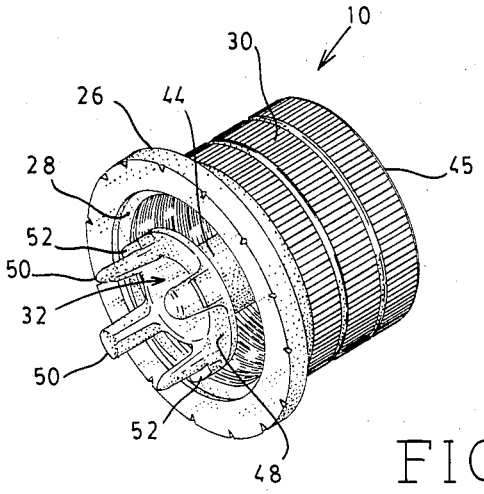
FIG. 1 illustrates a perspective view of a combined magazine cap and choke wrench of the present invention.
Figure 2:
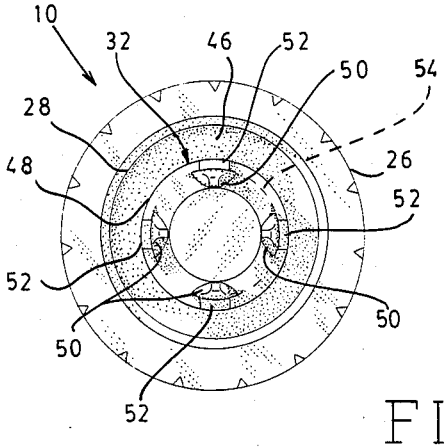
FIG. 2 illustrates a bottom view of a combined magazine cap and choke wrench of the present invention.

As illustrated in FIGS. 1 through 3, the combined magazine cap and choke wrench 10 generally comprises a cap body 26 defining a threaded recess 28 for releasably receiving the outboard end portion 22 of the magazine 16, thereby securing the magazine 16 in the bracket 18, and, resultantly, releasably securing the barrel and the outboard end portion 22 of the magazine 16 together. Further, in the preferred illustrated embodiment the magazine cap 10 has annular sides defining a ribbed or knurled exterior surface 30 to facilitate the gripping of the cap 10.

Figure 4:
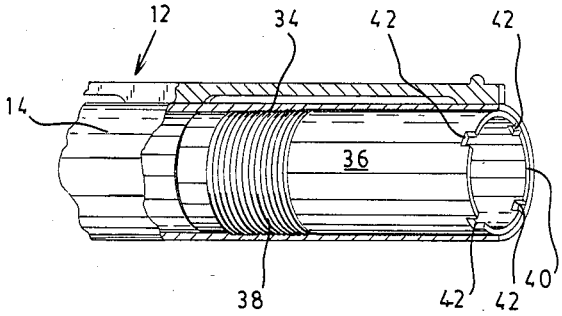
FIG. 4 is a perspective view, partially in section, of a conventional shotgun choke as it is threadably received in the barrel of a shotgun.
Figure 5:
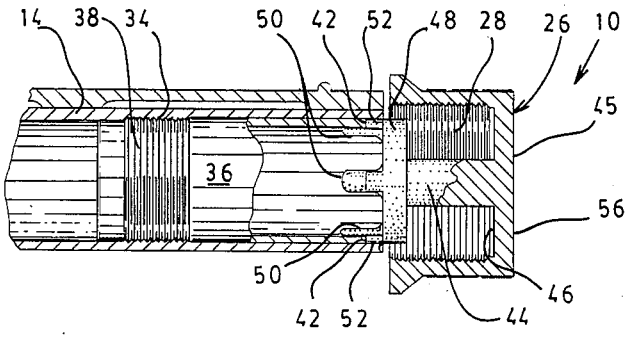
FIG. 5 is a side elevation view, partially in section, of a combined magazine cap and choke wrench of the present invention as it engages a conventional shotgun choke.

The magazine cap 10 further comprises a choke wrench portion 32 for installing and removing a shotgun choke. In this regard, certain shotguns are provided with barrels, such as the barrel 14 of FIG. 4, which have muzzle portions defining threaded interior surfaces 34 for releasably receiving a shotgun choke 36. It will be understood that choking devices such as the illustrated choke 36 serve to control the pattern of the shot discharged from the barrel 14, and the ability to releasably install and interchange choking devices greatly enhances the versatility of the shotgun. The choke 36, illustrative of a conventional choking device, comprises a tube defining an exterior threaded surface 38 which allows the choke to be threadably received in the muzzle of the barrel 14. To facilitate the installation and removal of the choke 36, the forward end portion 40 of the conventional choke 36 is provided with two or more wrench receiving notches or slots 42, which heretofore were provided for receiving a conventional choke wrench.

The choke wrench portion 32 of the magazine cap 10 generally comprises a wrench stem 44 coaxially mounted on the interior surface 46 of the head portion 45 of the cap 10. A wrench base 48 is mounted on the outboard end of the stem 44 and carries alignment means, such as the alignment members 50, and carries two or more spline members 52 disposed so as to register with, and be releasably received by, the slots 42 of the choke 36. It will be noted that in the preferred illustrated embodiment, the wrench portion 32 is provided with four spline members 52 to correspond to the four slots 42 provided in the choke 36, but it will be appreciated that the number of spline members 52 can vary according to the configuration of the choke utilized.

In utilizing the combined magazine cap and choke wrench 10 of the present invention to install or remove the choke 36 from the barrel 14, it will be understood that the guide members 50 are closely received in the forward end portion 40 of the choke 36 with the spline members 52 being received in the slots 42. With the wrench portion 32 thusly engaging the forward end portion 40 of the choke 36, rotation of the cap 10 serves to rotate the choke 36 to facilitate its installation or removal. It will be noted that the guide members 50 serve to assist in the insertion of the spline members 52 into the slots 42 and to help maintain the seated position of the members 52 in the slots 42 during rotation of the cap 10. However, it will be understood that the guide members 50 are illustrative of one suitable guide means and other means can be utilized. For example, the guide means can comprise a cylindrical sleeve, as illustrated by the broken lines at 54, which is closely received in the forward end portion 40 of the choke 36.

Figure 6:
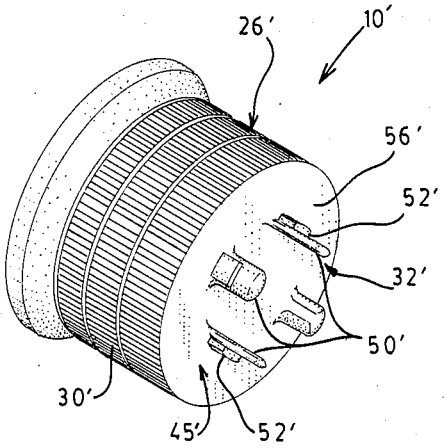
FIG. 6 is a perspective view of an alternate embodiment of the combined magazine cap and choke wrench of the present invention.

In FIG. 6, an alternate embodiment of the combined magazine cap and choke wrench of the present invention is illustrated at 10'. In the illustrated embodiment of the cap 10' the wrench portion 32' is mounted on the exterior surface 56' of the head portion 45' of the cap body 26' rather than on the interior surface 46 within the recess 28. The wrench portion 32' comprises suitable guide means such as the illustrated guide members 50' and two or more spline members 52' which protrude from the exterior surface 56'. As with the cap 10, the wrench portion 32' is utilized by inserting the guide members 50' into the forward end portion 40 of the choke 36, and the spline members 52' in the slots 42, and rotating the cap body 26'.

In light of the above it will be appreciated that the magazine cap 10 serves not only as a magazine cap, but also as a choke wrench to facilitate the installation and removal of shotgun chokes. Resultantly, when the combined magazine cap and choke wrench of the present invention is used with a shotgun, there is no need to carry a separate choke wrench, and the operator of the shotgun is always assured of having a wrench available for installing or removing a choke.

While a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. A combined magazine cap and choke wrench for use with a shotgun having a tubular magazine provided with an outboard portion, a barrel and a fore-end grip, and for facilitating the installation and removal of a tubular shotgun choke from said barrel of said shotgun, said shotgun choke having a forward end portion provided with at least two slots, said combined magazine cap and choke wrench comprising:

a cap body defining an annular recess for releasably engaging said outboard end portion of said tubular magazine, whereby said barrel and said tubular magazine are releasably secured together and/or whereby said fore-end grip is releasably secured on said shotgun, said cap body having a head portion defining an interior surface within said annular recess and an exterior surface exterior to said annular recess; and a choke wrench portion mounted on said cap body, said wrench portion including at least two spline members for registering with and for being releasably received in said slots of said choke, whereby selected rotation of said cap body results in selected rotation of said choke thereby facilitation the installation and removal of said choke.

2. The combined magazine cap and choke wrench of claim 1 wherein said choke wrench portion comprises a wrench stem substantially coaxially mounted within said annular recess, said wrench stem defining an outboard end, said wrench portion further comprising a wrench base mounted on said outboard end of said wrench stem for carrying said spline members.

3. The combined magazine cap and choke wrench of claim 1 wherein said choke wrench portion further comprises guide means for being closely received in said forward end portion of said choke whereby the positioning of said spline members in said slots is facilitated.

4. The combined magazine cap and choke wrench of claim 3 wherein said guide means comprises a plurality of guide members for being closely received in said forward end portion of said choke as said spline members are aligned to register with said slots.

5. The combined magazine cap and choke wrench of claim 3 wherein said guide means comprises a sleeve member for being closely received in said forward end portion of said choke as said spline members are aligned to register with said slots.

6. The combined magazine cap and choke wrench of claim 2 wherein said choke wrench portion further comprises guide means for being closely received in said forward end portion of said choke whereby the positioning of said spline members in said slots is facilitated.

7. The combined magazine cap and choke wrench of claim 6 wherein said guide means comprises a plurality of guide members for being closely received in said forward end portion of said choke as said spline members are aligned to register with said slots.

8. The combined magazine cap and choke wrench of claim 6 wherein said guide means comprises a sleeve member for being closely received in said forward end portion of said choke as said spline members are aligned to register with said slots.

9. The combined magazine cap and choke wrench of claim 1 wherein said spline members are mounted on, and protrude from, said exterior surface of said head portion of said cap body.

10. The combined magazine cap and choke wrench of claim 9 wherein said choke wrench portion further comprises guide means for being closely received in said forward end portion of said choke whereby the positioning of said spline members in said slots is facilitated.

11. The combined magazine cap and choke wrench of claim 10 wherein said guide means comprises a plurality of guide members for being closely received in said forward end portion of said choke as said spline members are aligned to register with said slots.

12. The combined magazine cap and choke wrench of claim 10 wherein said guide means comprises a sleeve member for being closely received in said forward end portion of said choke as said spline members are aligned to register with said slots.

13. A combined magazine cap and choke wrench for use with a shotgun having a tubular magazine provided with a threaded outboard end portion, a barrel and a fore-end grip, and for facilitating the installation and removal of a tubular shotgun choke from said barrel of said shotgun, said shotgun choke having a forward end portion provided with at least two slots, said combined magazine cap and choke wrench comprising:

a cap body defining a threaded annular recess for releasably engaging said outboard end portion of said tubular magazine, whereby said barrel and said tubular magazine are releasably secured together and/or whereby said fore-end grip is releasably secured on said shotgun, said cap body having a head portion defining an interior surface within said annular recess and an exterior surface exterior to said annular recess; and a choke wrench portion mounted on said cap body, said choke wrench portion including a wrench stem having a first end portion engaging said interior surface of said head portion of said cap body, and an outboard end, said wrench stem being substantially coaxially aligned within said annular recess, said wrench portion further including a wrench base mounted on said outboard end of said wrench stem, said wrench base carrying at least two spline members for registering with and being releasably received in said slots of said choke, whereby selected rotation of said cap body results in selected rotation of said choke thereby facilitating the installation and removal of said choke, said wrench portion further including guide means, whereby the positioning of said spline members in said slots is facilitated, said guide means comprising at least two guide members for being closely received in said forward end portion of said tubular choke as said spline members are aligned to register with said slots.

14. A combined magazine cap and choke wrench for use with a shotgun having a tubular magazine provided with a threaded outboard end portion, a barrel and a fore-end grip, and for facilitating the installation and removal of a tubular shotgun choke from said barrel of said shotgun, said shotgun choke having a forward end portion provided with at least two slots, said combined magazine cap and choke wrench comprising:

a cap body defining a threaded annular recess for releasably engaging said outboard end portion of said tubular magazine, whereby said barrel and said tubular magazine are releasably secured together and/or whereby said fore-end grip is releasably secured on said shotgun, said cap body having a head portion defining an interior surface within said annular recess and an exterior surface exterior to said annular recess; and a choke wrench portion mounted on said cap body, said choke wrench portion including at least two spline members mounted on and protruding from said exterior surface of said head portion of said cap body for registering with and being releasably received in said slots of said choke, whereby selected rotation of said cap body results in selected rotation of said choke thereby facilitating the installation and removal of said choke, said wrench portion further including guide means, whereby the positioning of said spline members in said slots is facilitated, said guide means comprising at least two guide members for being closely received in said forward end portion of said tubular choke as said spline members are aligned to register with said slots.

15. The combined magazine cap and choke wrench of claim 13 wherein said wrench portion comprises four said spline members and four said guide members.

16. The combined magazine cap and choke wrench of claim 14 wherein said wrench portion comprises four said spline members and four said guide members.

* * * * *